US006942129B2

(12) United States Patent
Ferraioli

(10) Patent No.: US 6,942,129 B2
(45) Date of Patent: Sep. 13, 2005

(54) FOOTWEAR DONNING DEVICE

(76) Inventor: Michael P. Ferraioli, 102 E. 7th St., New York, NY (US) 10009

( * ) Notice: Subject to any disclaimer, the term of this patent is extended or adjusted under 35 U.S.C. 154(b) by 210 days.

(21) Appl. No.: 10/092,816

(22) Filed: Mar. 7, 2002

(65) Prior Publication Data

US 2002/0139819 A1 Oct. 3, 2002

Related U.S. Application Data

(60) Provisional application No. 60/280,914, filed on Apr. 2, 2001.

(51) Int. Cl.[7] ..... A47G 25/80
(52) U.S. Cl. ..... 223/113; 223/118
(58) Field of Search ..... 223/113, 112, 223/118; D2/641

(56) References Cited

U.S. PATENT DOCUMENTS

| | | | | |
|---|---|---|---|---|
| 594,894 | A | | 12/1897 | Nylander |
| 1,690,516 | A | * | 1/1928 | Wickers ..... 223/118 |
| 2,903,170 | A | | 9/1959 | Ahn |
| 3,604,604 | A | | 9/1971 | Ahn |
| 5,505,350 | A | | 4/1996 | Migliorini |
| 5,513,783 | A | | 5/1996 | White |
| 5,593,071 | A | | 1/1997 | Lusk |
| 5,601,220 | A | | 2/1997 | Vossen |
| 5,626,269 | A | | 5/1997 | Duarte |
| 5,630,534 | A | | 5/1997 | Maier et al. |
| 5,632,424 | A | | 5/1997 | Maier et al. |
| 5,636,774 | A | | 6/1997 | Moscato |
| 5,651,483 | A | | 7/1997 | Bell et al. |
| 5,673,826 | A | | 10/1997 | Stolk |
| 5,687,889 | A | | 11/1997 | Liden |
| 5,706,988 | A | | 1/1998 | Moore |
| 5,741,569 | A | | 4/1998 | Votino et al. |
| 5,743,446 | A | | 4/1998 | Roda-Balzarini |
| 5,769,289 | A | | 6/1998 | Lusk |
| 5,799,844 | A | | 9/1998 | James |
| 5,826,761 | A | | 10/1998 | Basaj |
| 5,894,970 | A | | 4/1999 | Belkin et al. |
| 5,904,279 | A | | 5/1999 | Bertram et al. |
| 5,909,831 | A | | 6/1999 | Griffin |
| 5,924,609 | A | | 7/1999 | Stolk et al. |
| 5,924,610 | A | | 7/1999 | Willemin |
| 5,927,573 | A | | 7/1999 | Votino et al. |
| 5,941,431 | A | | 8/1999 | Parker |
| 5,992,712 | A | | 11/1999 | Nishikawa et al. |
| 6,032,839 | A | | 3/2000 | Joosten et al. |
| 6,056,171 | A | * | 5/2000 | Santamaria ..... 223/112 |
| 6,065,654 | A | | 5/2000 | Evensen |
| 6,102,262 | A | | 8/2000 | Nicholson |
| 6,276,578 | B1 | | 8/2001 | Stenger |
| 6,283,342 | B1 | * | 9/2001 | Wilkerson ..... 223/112 |

* cited by examiner

*Primary Examiner*—John J. Calvert
*Assistant Examiner*—James G Smith
(74) *Attorney, Agent, or Firm*—John W. LaBatt, Esq.; Hoffman, Warnick & D'Alessandro LLC

(57) ABSTRACT

The invention provides a footwear donning device. The device includes a carriage for holding the footwear, a flexible fore handle coupled to the carriage and a handle coupled to the fore handle for donning the footwear.

35 Claims, 6 Drawing Sheets

FOOTWEAR DONNING DEVICE

REFERENCE TO PRIOR APPLICATION

The current application claims priority to co-pending provisional application Ser. No. 60/280,914, filed on Apr. 2, 2001 and incorporated herein by reference.

BACKGROUND OF THE INVENTION

1. Technical Field

The invention generally relates to devices for the removal, retrieval and/or donning of footwear. Specifically, the invention provides a device for donning footwear. The device can assist, for example, in donning a sock or a shoe. Additionally, the device can be configured to further assist in removing and retrieving footwear.

2. Background Art

Many people have a varying lack of mobility. As a result, the donning, removal and retrieval of a sock, a shoe, and other footwear become difficult tasks to perform.

Several devices are available to assist individuals in donning footwear. However, many of these devices have costly, multi-part assemblies that do not incorporate all of the required functionality, require an unduly amount of preparation, are difficult to use and/or have awkward setup and storage requirements. Consequently, these devices fail to account for all the needs of a disabled individual.

For example, several devices require the user to lift a foot to place the foot into the opening of a sock secured on the device. Many users may find this task difficult to perform independently, because of the balancing required and/or the strength required in the legs. Therefore, an individual may require assistance to use the device, defeating its purpose. Additionally, several devices have parts and/or joints that are not flexible. A lack of flexibility increases the difficulty of operating these devices and also increases the likelihood of damaging the footwear due to use of the device.

As a result of the deficiencies described above, there exists a need for a device to assist an individual in donning, removing and/or retrieving footwear that is inexpensive and can easily be operated independently by a disabled individual.

SUMMARY OF THE INVENTION

The current invention provides a footwear donning device. The device can further assist in removing and retrieving footwear.

A first aspect of the invention provides a footwear donning device, comprising: a carriage for holding the footwear; a fore handle coupled to the carriage, wherein the fore handle is flexible; and a handle coupled to the fore handle for donning the footwear.

A second aspect of the invention provides a device for donning and removing a sock, comprising: a handle for donning the sock; a fore handle coupled to the handle, wherein the fore handle is flexible; a carriage for holding the sock during donning, wherein the carriage is coupled to the fore handle; and a horn for removing the sock coupled to the handle opposite the fore handle.

A third aspect of the invention provides a footwear donning device, comprising: a carriage for holding the footwear, the carriage including: a carrier plate having a pair of opposing sides and a rounded end; a pair of hook lobes, each hook lobe attached to a side of the carrier plate using a flexible joint; a pair of stems attached to the carrier plate opposite the rounded end, wherein each stem is located proximate a hook lobe; and a pair of yokes, wherein each yoke is located adjacent a stem; a fore handle attached to the carriage, wherein each yoke is further adjacent the fore handle; and a handle attached to the fore handle for donning the footwear.

The exemplary aspects of the present invention are designed to solve the problems herein described and other problems not discussed, which are discoverable by a skilled artisan.

BRIEF DESCRIPTION OF THE DRAWINGS

These and other features of this invention will be more readily understood from the following detailed description of the various aspects of the invention taken in conjunction with the accompanying drawings in which.

It is noted that the drawings of the invention are not to scale. The drawings are intended to depict only typical aspects of the invention, and therefore should not be considered as limiting the scope of the invention. In the drawings, like numbering represents like elements between the drawings.

DETAILED DESCRIPTION OF THE INVENTION

The current invention provides a device for donning footwear. The device allows a user to retrieve, don and remove footwear, for example, a sock, with minimal or no bending at the waist.

Figures 1, 2, 3:
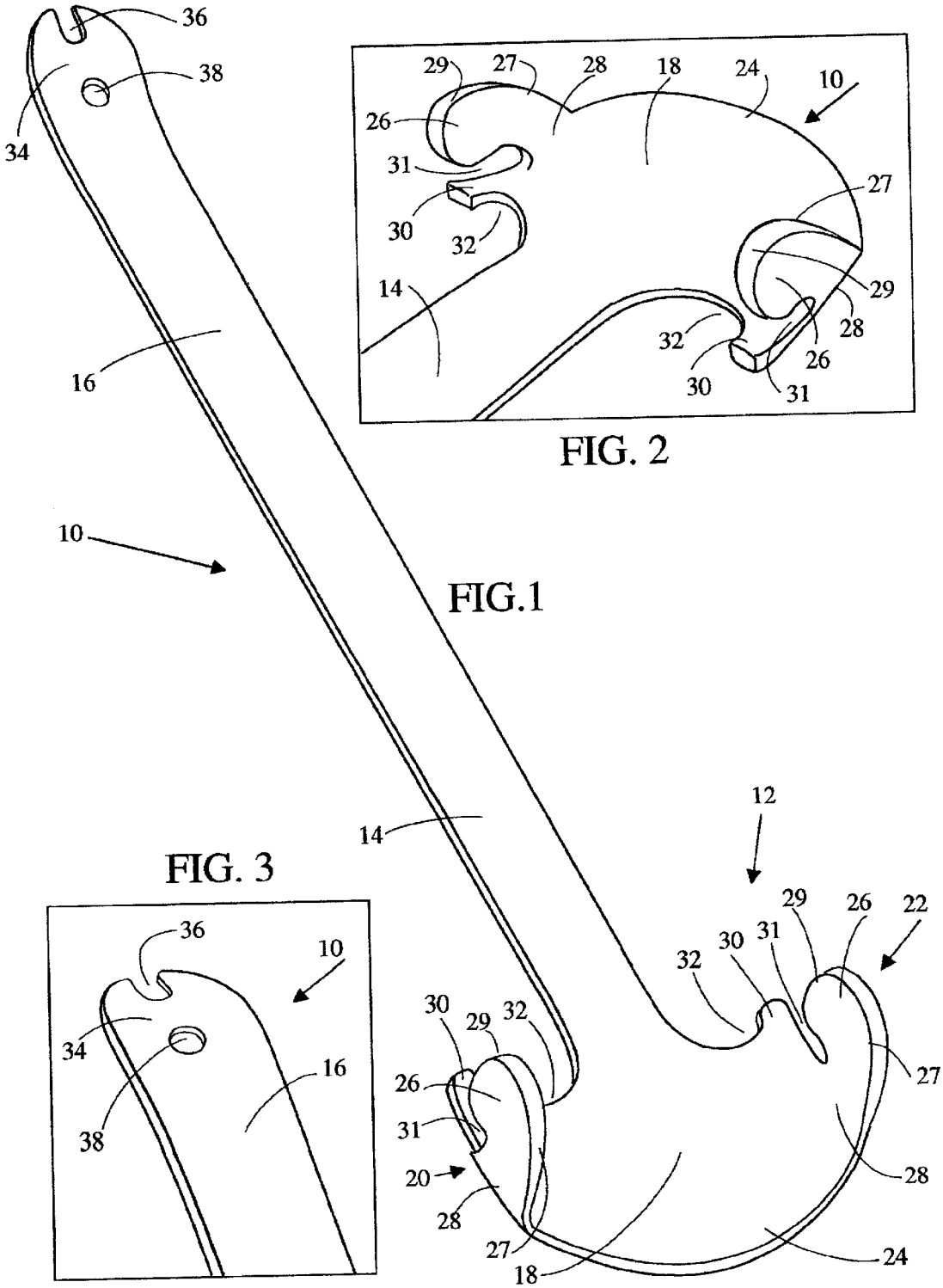
FIG. 1 shows a perspective view of a footwear donning device.
FIG. 2 shows a different perspective view of a portion of the device in FIG. 1.
FIG. 3 shows a different perspective view of a portion of the device in FIG. 1.

Turning to the figures, FIG. 1 shows a perspective view of a device 10 according to one aspect of the invention. Device 10 includes a carriage 12 coupled to a fore handle 14 which in turn is coupled to a handle 16. Use of the term "couple" encompasses various mechanisms of attaching parts, including, for example, molding two or more parts as one contiguous piece, and using glue, screws, rivets, hinges, hook and latch fasteners, tongue and groove, etc.

As shown in FIG. 1, device 10 can include a rounded carriage 12 that is longitudinally curved. Carriage 12 can include a carrier plate 18 with opposing sides 20, 22, located along the axis, each having a hook lobe 26 shown contiguously attached thereto at about a ninety degree angle. Carriage 12 is also shown including stems 30 and yokes 32 that can assist in gripping the footwear. Fore handle 14 is shown contiguous to both carriage 12 and handle 16. Handle 16 can be made firm to assist in operating device 10. Also shown contiguous with handle 16 is horn 34 shown including snare 36 which can be operated by rotating device 10 to remove footwear, retrieve footwear and/or use as a shoe horn while gripping, for example, handle 16.

Carriage 12 is configured to secure the particular footwear that a user desires to don.

FIGS. 1 and 2 show carriage 12 extending beyond fore handle 14, and including a carrier plate 18. Carrier plate 18 can have a pair of opposing sides 20, 22, and a rounded end 24 opposite fore handle 14. Carrier plate 18 can be longitudinally curved, or beveled, to assist a user in moving the device around the foot, i.e., the heel.

Carriage 12 is shown further including a pair of opposing hook lobes 26 that can be used to hold the footwear open during donning. Hook lobes 26 are each attached to a side 20, 22 of carrier plate 18 by a joint 28. As shown in FIG. 1, joints 28 can comprise a bend in a contiguous mold that forms a desired angle between carrier plate 18 and each hook lobe 26. Joints 28 can be flexible and remain relatively short in comparison to carrier plate 18. Each hook lobe 26 can extend at a right angle or slightly obtuse angle relative to carrier plate 18. When joints 28 are flexible, however, hook lobes 26 can form a range of acute and obtuse angles relative to carrier plate 18. Each hook lobe 26 is shown with a curved portion 27 extending toward fore handle 14 and a rounded portion 29 extending beyond joint 28 and toward fore handle 14. The curved portion 27 of hook lobes 26 rises to form a ramp to assist in placing footwear over each hook lobe 26. Carriage 12 is also shown including a pair of stems 30. Each stem 30 is located proximate a hook lobe 26 and can form a slot 31. A pair of yokes 32 are also shown adjacent to a stem 30 and adjacent to fore handle 14.

Fore handle 14 can be flexible to allow for easy application of the footwear. However, fore handle 14 should also be sufficiently firm to allow a user to easily control the movement and location of carriage 12 when holding handle 16. Handle 16 can be either semi-rigid or rigid and can be held by a user to operate the device. For example, handle 16 can be graduated to about a ten degree oval to reduce flexibility and increase its rigidity. Alternatively, handle 16 can be laterally curved, have a circular, square, triangular, etc. shape, and/or comprise a material that is not flexible, for example, wood, metal, a composite material, etc. Lateral curvature of handle 16 may also assist a user in gripping and operating device 10. The form of handle 16 may be selected to appropriately assist a user in gripping and operating device 10.

Device 10 is shown further comprising a horn 34 coupled to handle 16. As shown in FIGS. 1 and 3, horn 34 can be curved appropriately to allow it to function as a shoe horn. Additionally, horn 34 can include a snare 36 that can grip footwear during removal or retrieval. Device 10 is also shown including a hole 38. Hole 38 allows for easier storage, for example, by hanging device 10 on a wall from a nail, screw, etc. using hole 38 or a string slipped through hole 38. Hole 38 is shown located on handle 16 proximate horn 34. However, it should be recognized that hole 38 can be located anywhere on device 10, including carriage 12, fore handle 14 and horn 34.

Figure 4:
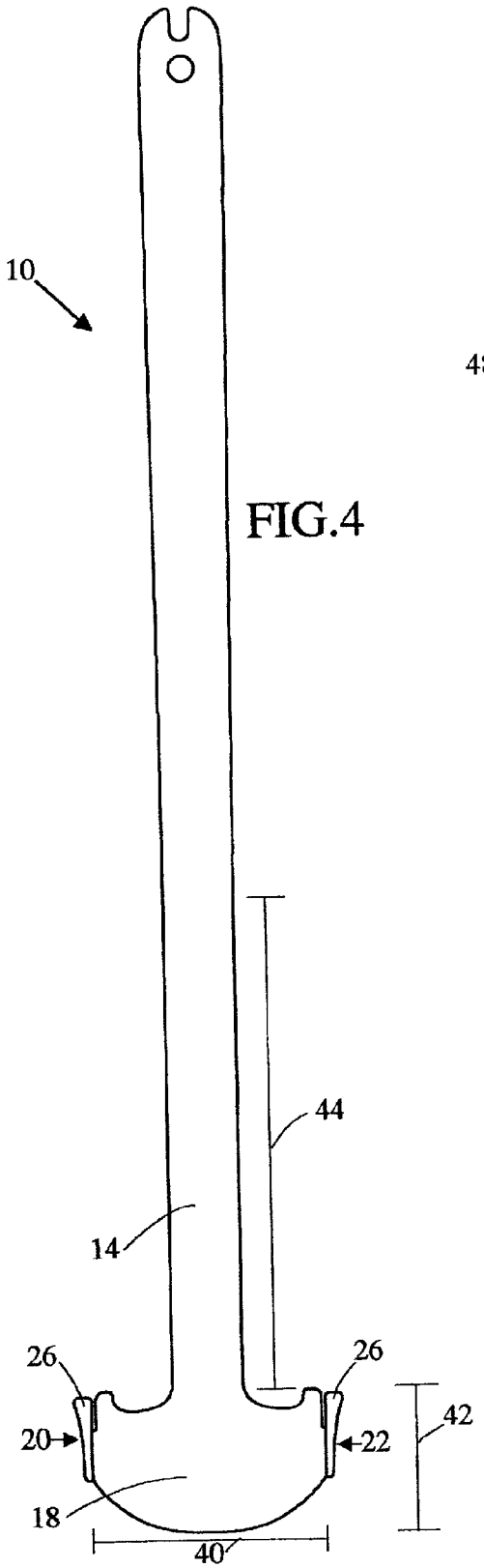
FIG. 4 shows a top view of a footwear donning device.

FIG. 4 shows a top view of device 10 according to one aspect of the invention. Hook lobes 26 are shown as being wider on the end towards fore handle 14. This configuration can assist in lessening pressure on the footwear during donning.

Carrier plate 18 can have a distance 40 between opposing sides 20, 22 that is appropriate for a particular sized foot. For example, to accommodate a user having a wide foot, i.e. EEEE shoe size, distance 40 can be about four inches. Relative to distance 40, carrier plate 18 extends only a short distance 42 beyond fore handle 14. This allows for a minimal amount of surface resistance during use to smoothly bring carrier plate 18 under the foot, around the heel and up the leg. For example, for a larger foot as described above, distance 42 would be at most approximately two and a half inches. Additionally, fore handle 14 can be a desired length 44 depending on the size of a user's foot. For example, length 44 can be about nine inches to easily accommodate a long foot (i.e. size fifteen plus). It should be noted, however, that a particular length 44 is not necessary for a particular foot size, rather a particular length 44 can make operation of device 10 easier for a particular foot size.

Figure 5:
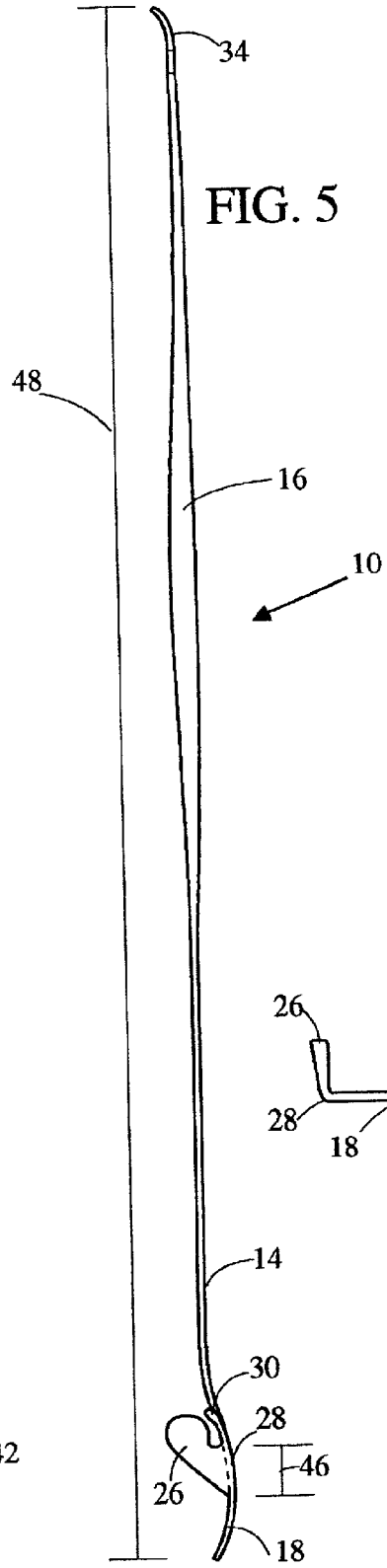
FIG. 5 shows a side view of a footwear donning device.

FIG. 5 shows a side view of device 10 according to one aspect of the invention. Fore handle 14 is shown flat which can allow for maximum bi-directional flexibility. Handle 16 is shown curved to allow for reduced flexibility in comparison to fore handle 14. Handle 16 is shown with the curve gradually increasing to a maximum and then gradually decreasing as it moves toward horn 34. Alternatively or in addition to curving handle 16, handle 16 can be formed so that handle 16 has a gradually increasing oval cross-section as it moves away from fore handle 14, which reaches a maximum before gradually decreasing as it moves toward horn 34. For example, handle 16 may have a maximum oval of about 10 degrees before flattening as it moves toward horn 34 and flexible handle 14. Horn 34 is shown curved relative to handle 16, this can allow for easier use as a shoehorn and can aid in the removal and retrieval of footwear. Carrier plate 18 is also shown having a slight longitudinal curve, or bevel, which can aid a user in sliding carrier plate 18 around a heel of a foot. Stems 30 are shown as being wider on the end towards fore handle 14. This configuration can assist in lessening pressure on the footwear during donning. Stems 30 are also shown with a slight curve that can assist in gripping the footwear with hook lobes 26 when used in donning footwear.

As discussed above, joints 28 can be short in comparison to distance 42 (shown in FIG. 4). For example, if distance 42 is approximately two and a half inches as described above, joints 28 would have a length 46 of approximately three-quarters of an inch. Maintaining relatively short joints 28 as compared with distance 42, allows carrier plate 18 to maintain greater flexibility. To accommodate most users, when fully extended, device 10 can have a total length 48 of about twenty-eight inches from one end of handle 16 (or horn 34) to the rounded end 24 of carrier plate 18.

Figure 6:
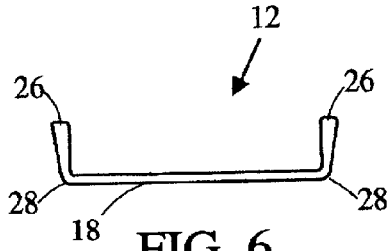
FIG. 6 shows a cross-sectional view of a carriage portion of a footwear donning device.

FIG. 6 shows a cross-sectional view of carriage 12 according to one aspect of the invention. As shown, each hook lobe 26 makes roughly a right angle with carrier plate 18 at joint 28. Additionally, hook lobes 26 are shown to be wider than joint 28. This can allow for more flexible joints 28 while maintaining a desired strength in hook lobes 26 during operation.

As shown in FIG. 1, device 10 can comprise a single molded unit. For example, device 10 can be made from a single plastic mold, i.e., polypropylene, a composite plastic, etc. having a thickness of about one-sixteenth of an inch. The thickness may be thicker for certain parts, for example, handle 16 can be thickened to increase its firmness as discussed above. Any suitable material and/or thickness that provides sufficiently firm, flexible, gripping, guiding, pushing, compression and tensile characteristics can be used for device 10. Alternatively, portions of device 10 can be formed separately and later permanently or temporarily coupled using any mechanism now known or later developed. For example, various parts of device 10 can be coupled using glue, screws, hinges, hook and latch fasteners, tongue and groove, etc.

As discussed previously, fore handle 14 and joints 28 can maintain limited flexibility to assist in operating the device. Additionally, other parts, including, carrier plate 18, hook lobes 26, stems 30, handle 16 and horn 34 can maintain limited flexibility in the respective shapes of the parts so that use of device 10 can be made easier.

Figure 7:
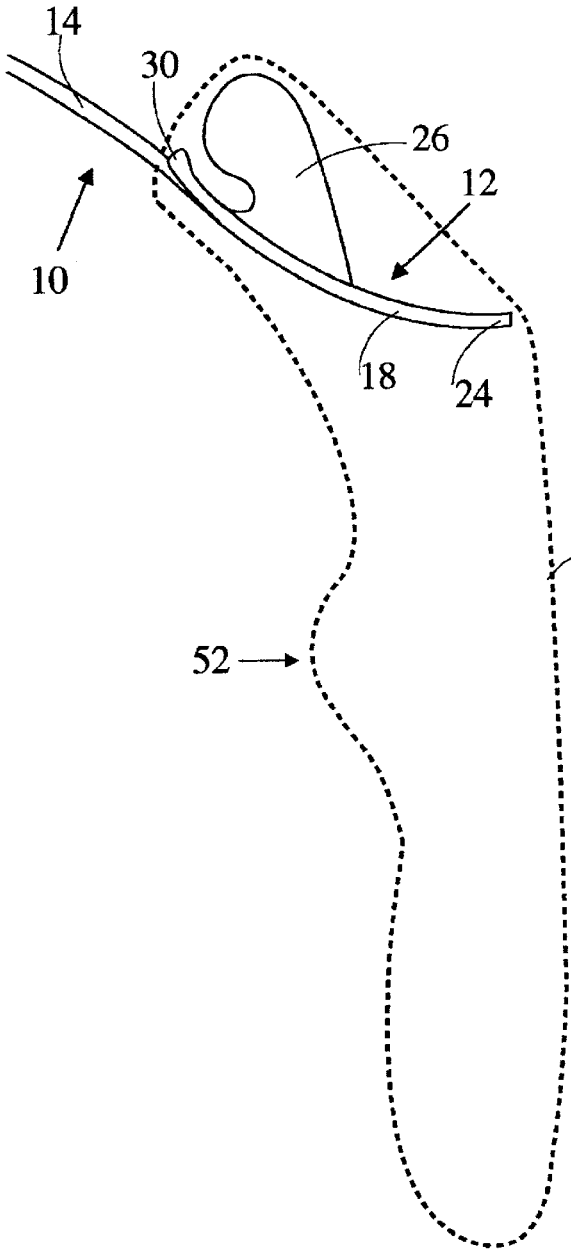
FIG. 7 shows a cross-sectional view of a sock loaded onto a footwear donning device.
Figure 8:
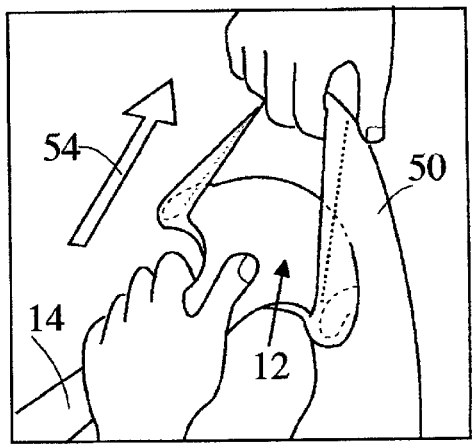
FIG. 8 shows a perspective view of securing the sock as shown in FIG. 7.
Figure 9:
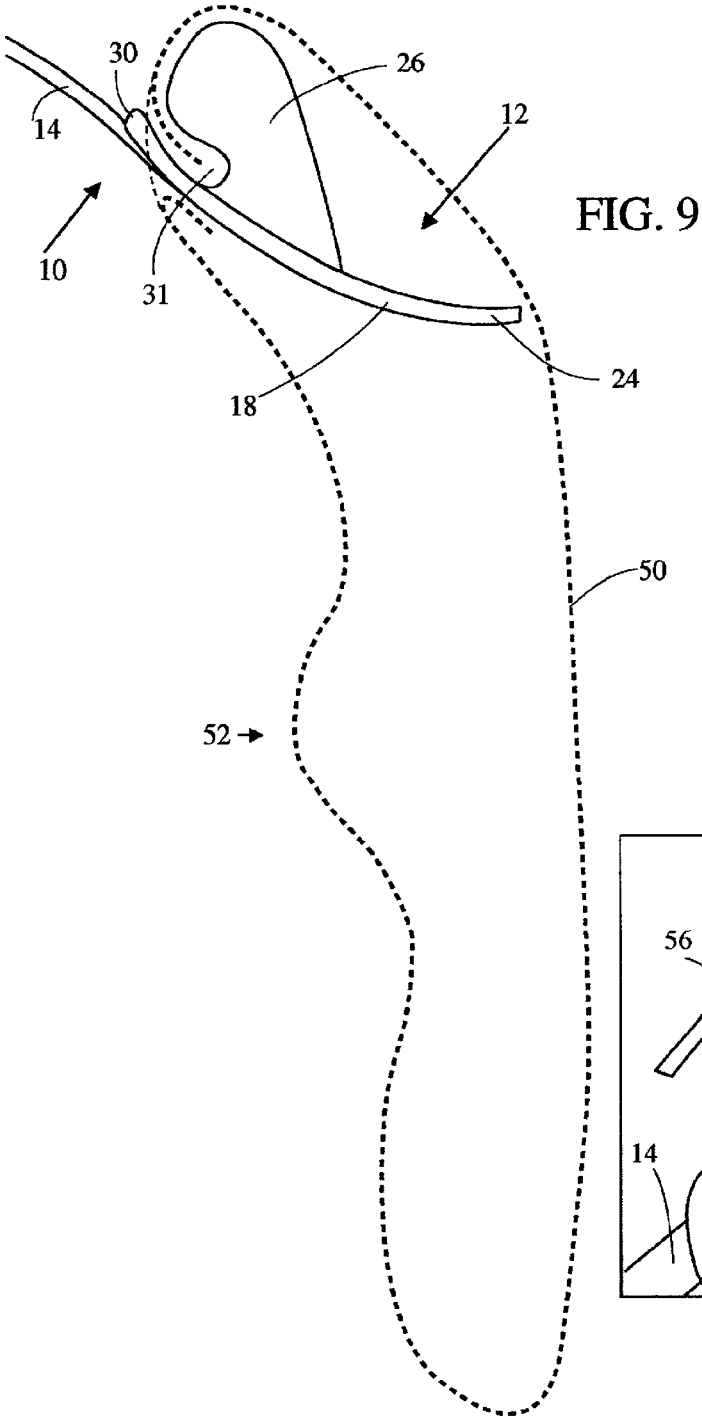
FIG. 9 shows a cross-sectional view of a sock loaded onto a footwear donning device.
Figure 10:
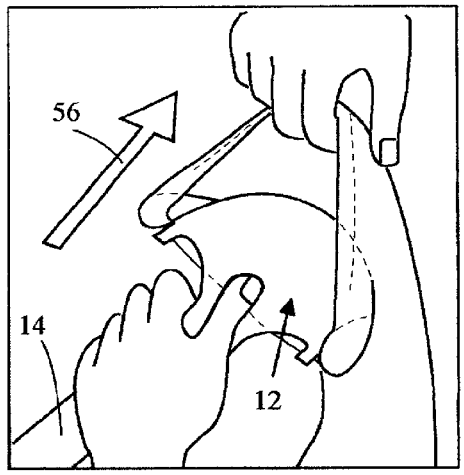
FIG. 10 shows a perspective view of securing the sock as shown in FIG. 9.

Donning, removing and retrieving a sock are exemplary applications of device 10. To begin donning, the sock must be secured onto carriage 12. FIGS. 7 and 9 each show a partial cross-sectional view of device 10 having a sock 50 secured onto carriage 12 according to alternative aspects of the invention. Carrier plate 18 can be partially secured into an open end of sock 50 starting at rounded end 24. Sock 50 can be aligned so that a heel portion 52 is aligned substantially in the center of carriage 12 and on the opposite side of hook lobes 26. A rim of sock 50 can then be lifted over the pair of hook lobes 26. Various methods can subsequently be used to secure sock 50 for donning. For example, as shown in FIG. 7, a rim of sock 50 can be folded around each stem 30, and pulled as shown by arrow 54 in FIG. 8 to secure the grip. Alternatively, as shown in FIG. 9, a rim of sock 50 can be folded between each hook lobe 26 and stem 30 pair into slot 31 and pulled as shown by arrow 56 in FIG. 10 to secure the grip. It should be noted, however, that these methods are only exemplary of the possible methods for securing sock 50 and other methods are equally covered under the current invention.

Figure 11:
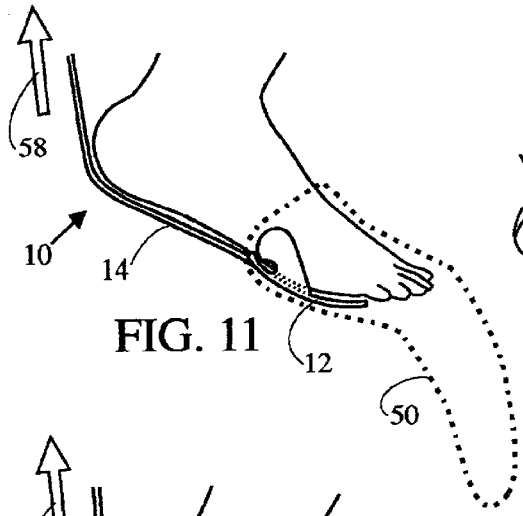
FIG. 11 shows a first view of donning a sock using a footwear donning device.
Figure 12:
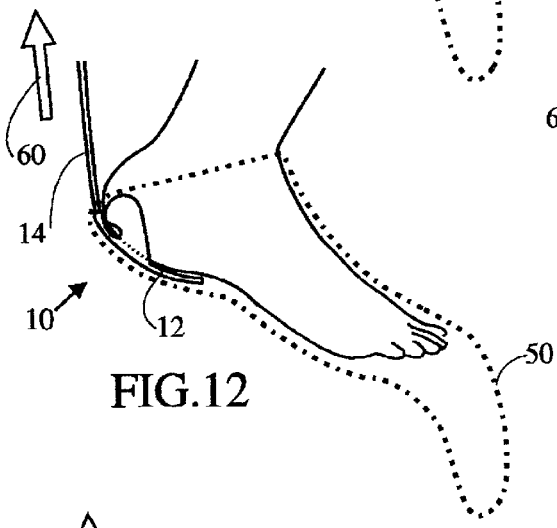
FIG. 12 shows a second view of donning a sock using the device of FIG. 11.
Figure 13:
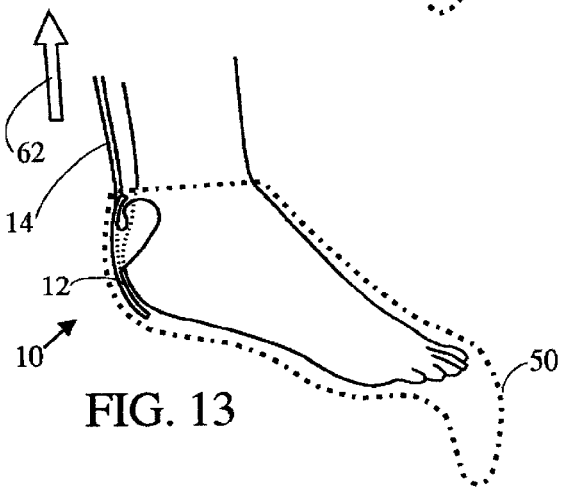
FIG. 13 shows a third view of donning a sock using the device of FIG. 11.
Figure 14:
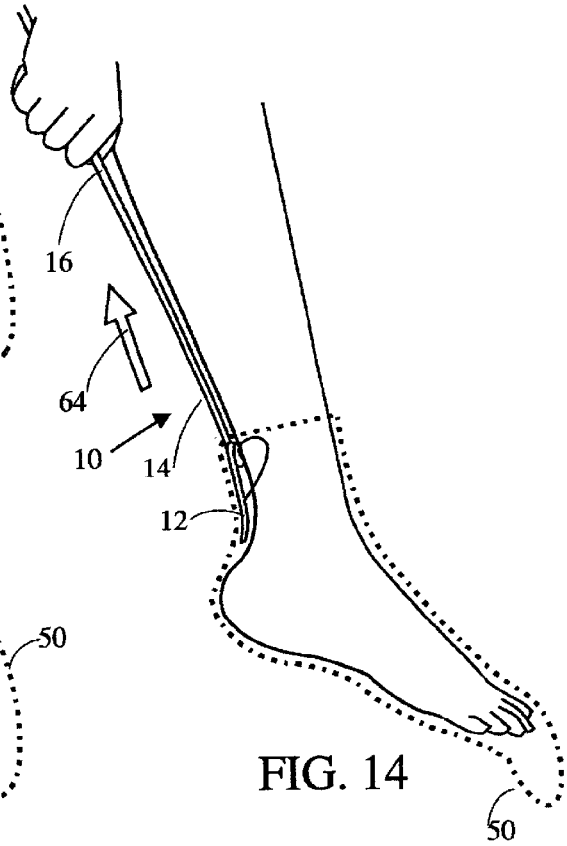
FIG. 14 shows a fourth view of donning a sock using the device of FIG. 11.

Once secured onto carriage 12, sock 50 is ready to be donned. As shown in FIG. 1, a user can hold handle 16 of device 10 to move carriage 12 near the desired foot. FIG. 11 shows how a foot can then be aligned to enter sock 50 from the opening near fore handle 14 or such that a portion of the foot enters sock 50. As shown in FIGS. 11–14, once appropriately placed, the user can move handle 16 in a direction indicated by arrows 58, 60, 62, 64 such that fore handle 14 and carriage 12 move along the foot (FIG. 12), around the heel (FIG. 13) and along the leg (FIG. 14). As a result, sock 50 is pulled along the foot, around the heel and up the leg as shown in each of FIGS. 12 through 14. If required, device 10 can continue to be used to lift the foot to remove sock 50 from carriage 12 and perform any desired adjustment to sock 50 on the foot. When adjusting sock 50, the foot can be rested at an intermediary level, for example, on a chair rung, a foot stool, etc.

Figure 15:
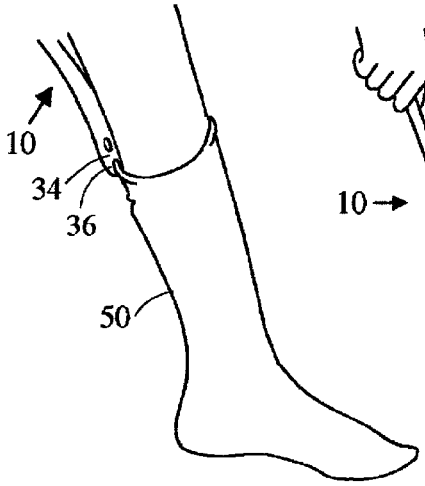
FIG. 15 shows a first view of removing a sock using a footwear donning device.
Figure 16:
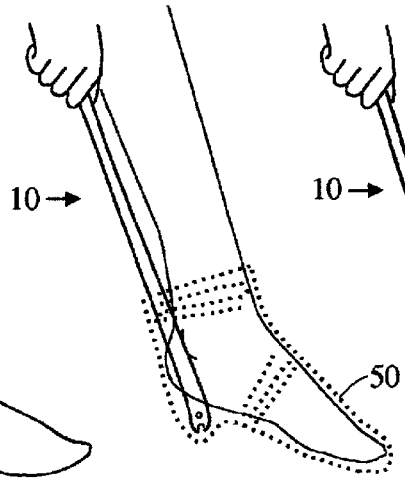
FIG. 16 shows a second view of removing a sock using the device of FIG. 15.
Figure 17:
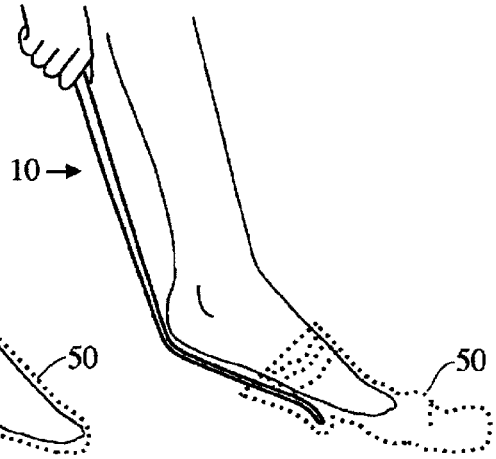
FIG. 17 shows a third view of removing a sock using the device of FIG. 15.

Removing a sock from a foot can be performed using horn 34 and/or snare 36 shown in FIGS. 1 and 3. For example, as shown in FIG. 15, horn 34 can be placed near the uppermost portion of the sock and either inserted between the sock and leg or a rim of the sock can be placed into snare 36. Device 10 can then be moved toward the foot, thereby causing sock 50 to pull downward and off of the leg as shown in FIGS. 16 and 17.

Figure 18:
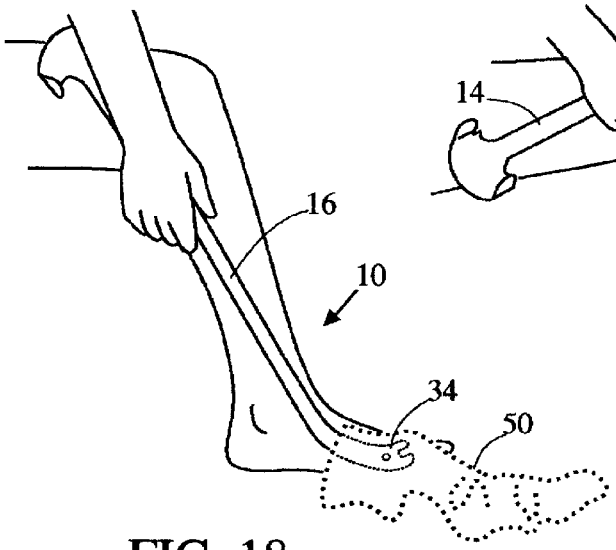
FIG. 18 shows a first view of retrieving a sock using a footwear donning device.
Figure 19:
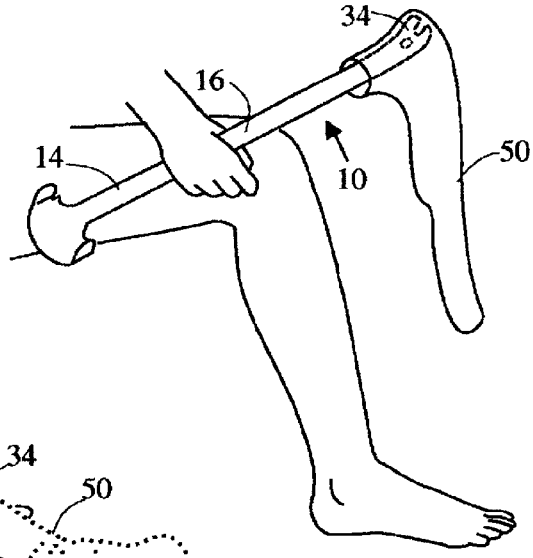
FIG. 19 shows a second view of retrieving a sock using the device of FIG. 18.

Device 10 can also be used to retrieve sock 50 from the foot or floor area. For example, after removing a sock as discussed above, handle 16 and/or horn 34 may remain in the sock. Alternatively, a user can position a portion of handle 16 and/or horn 34 into a sock. As shown in FIGS. 18 and 19, for example, device 10 can be lifted to retrieve sock 50. Handle 16 can be held in such a manner that allows the relative curvature of horn 34 to handle 16 to assist in holding sock 50 as it is moved upward.

While the previous descriptions depict exemplary uses of the device, other methods of use are possible and are readily apparent based on this description. Additional aspects of using the device are also readily apparent, for example, the device can be used in an upright, sitting or reclined position.

The foregoing description of various aspects of the invention has been presented for purposes of illustration and description. It is not intended to be exhaustive or to limit the invention to the precise form disclosed, and obviously, many modifications and variations are possible. Such modifications and variations that may be apparent to a person skilled in the art are intended to be included within the scope of the invention as defined by the accompanying claims.

What is claimed is:

1. A footwear donning device, comprising:

a carriage for holding the footwear, wherein the carriage includes:

a pair of opposing hook lobes; and a pair of yokes;

a fore handle coupled to the carriage, wherein the fore handle is flexible, and wherein each yoke is adjacent to the fore handle, and a handle coupled to the fore handle for donning the footwear.

2. The device of claim 1, wherein the carriage includes a carrier plate having:

a pair of opposing sides extending beyond the fore handle; and a rounded end opposite the fore handle.

3. The device of claim 2, wherein the opposing sides are about 4 inches apart.

4. The device of claim 2, wherein the carrier plate extends beyond the fore handle by at most approximately 2.5 inches.

5. The device of claim 1, wherein the carriage further includes a pair of stems, wherein each stem is located proximate a hook lobe and adjacent to a yoke.

6. The device of claim 1, wherein the carriage further includes a pair of opposing joints, wherein each joint attaches a hook lobe to an opposing side of the carriage.

7. The device of claim 6, wherein each hook lobe includes:

a curved portion; and a rounded portion extending beyond the joint and toward the fore handle.

8. The device of claim 6, wherein each joint is flexible.

9. The device of claim 6, wherein each joint is less than approximately 0.75 inches long.

10. The device of claim 1, further comprising a horn coupled to the handle for assisting in removing footwear.

11. The device of claim 10, wherein the horn includes a snare.

12. The device of claim 10, wherein the horn further assists in donning a shoe.

13. The device of claim 1, further comprising a hole for storing the device.

14. The device of claim 1, wherein the fore handle has a length of about 9 inches.

15. The device of claim 1, having a length of about 28 inches.

16. The device of claim 1, wherein the handle is graduated to about a 10 degree oval.

17. The device of claim 1, wherein the carriage, the fore handle and the handle comprise a single molded unit.

18. The device of claim 17, comprising of one of the group consisting of polypropylene and a composite plastic.

19. A device for donning and removing a sock, comprising:

a handle for donning the sock;

a fore handle coupled to the handle, wherein the fore handle is flexible;

a longitudinally curved carriage for holding the sock during donning, wherein the carriage is coupled to the fore handle; and a horn for removing the sock coupled to the handle opposite the fore handle.

20. The device of claim 19, further comprising a hole for storing the device.

21. The device of claim 20, wherein the hole is located on the handle proximate the horn.

22. The device of claim 19, wherein the horn further assists in donning a shoe.

23. The device of claim 19, wherein the carriage includes:

a carrier plate having a pair of opposite sides extending beyond the fore handle and a rounded end located opposite the fore handle;

a pair of hook lobes, each hook lobe forming an obtuse angle with a side of the carrier plate; and a pair of joints, each joint attaching a portion of a hook lobe to a side of the carrier plate.

24. The device of claim 23, wherein the carriage further includes:

a pair of stems, each stem proximate a hook lobe; and a pair of yokes, each yoke adjacent a stem and the fore handle.

25. A footwear donning device, comprising:

a carriage for holding the footwear, the carriage including:

a carrier plate having a pair of opposing sides and a rounded end;

a pair of hook lobes, each hook lobe attached to a side of the carrier plate using a flexible joint;

a pair of stems attached to the carrier plate opposite the rounded end, wherein each stem is located proximate a hook lobe; and a pair of yokes, wherein each yoke is located adjacent a stem;

a fore handle attached to the carriage, wherein each yoke is further adjacent the fore handle; and a handle attached to the fore handle for donning the footwear.

26. The device of claim 25, wherein the fore handle is flexible.

27. The device of claim 25, wherein each hook lobe includes a rounded portion extending beyond the joint and toward the fore handle.

28. The device of claim 25, further comprising a horn extending beyond the handle.

29. The device of claim 25, wherein the handle includes a hole located opposite the fore handle for storing the device.

30. The device of claim 1, wherein the carriage is longitudinally flexible.

31. A device for donning and removing a sock, comprising:

a handle for donning the sock;

a fore handle coupled to the handle; and a longitudinally curved carriage for holding the sock during donning, wherein the carriage is coupled to the fore handle.

32. The device of claim 31, wherein the fore handle is flexible.

33. The device of claim 31, wherein the carriage is longitudinally flexible.

34. The device of claim 1, wherein the carriage lifts the footwear during donning.

35. The device of claim 1, wherein the fore handle is flexible along a substantial portion of a length of the fore handle to conform to a heel of a user.

* * * * *